US008744302B2

(12) United States Patent
Matsushita et al.

(10) Patent No.: US 8,744,302 B2
(45) Date of Patent: Jun. 3, 2014

(54) CLEANING DEVICE, IMAGE FORMING APPARATUS, AND TRANSFER UNIT INCLUDING PRESSING UNIT

(75) Inventors: Kaoru Matsushita, Kanagawa (JP); Kazuyoshi Hagiwara, Kanagawa (JP); Kazutoshi Sugitani, Kanagawa (JP); Kuniaki Tanaka, Kanagawa (JP); Koichi Sato, Kanagawa (JP); Yuji Kamikawa, Kanagawa (JP); Koji Deguchi, Kanagawa (JP); Yusuke Sakai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 50 days.

(21) Appl. No.: 13/481,279

(22) Filed: May 25, 2012

(65) Prior Publication Data

US 2013/0136487 A1 May 30, 2013

(30) Foreign Application Priority Data

Nov. 28, 2011 (JP) ..... 2011-259374

(51) Int. Cl.
*G03G 21/00* (2006.01)

(52) U.S. Cl.
USPC ..... 399/101

(58) Field of Classification Search
USPC ..... 399/101, 349
See application file for complete search history.

(56) References Cited

U.S. PATENT DOCUMENTS 7,362,996 B2 * 4/2008 Facci et al. ..... 399/346

FOREIGN PATENT DOCUMENTS

JP A-09-237021 9/1997
JP A-2008-216316 9/2008

* cited by examiner

*Primary Examiner* — Quana M Grainger
(74) *Attorney, Agent, or Firm* — Oliff PLC

(57) ABSTRACT

A cleaning device includes a first cleaning member, a first opposing member, a second cleaning member, a second opposing member, and a pressing member. The first and second cleaning members clean an outer surface of a belt member by coming into contact with the outer surface. The first and second opposing members are in contact with an inner face of the belt member at positions that are opposite the first and second cleaning members. The pressing member is disposed between the first and second opposing members and is in contact with the outer surface of the belt member. The pressing member presses a portion of the belt member that is located between the first and second opposing members from an outer surface side of the belt member toward an inner face side of the belt member.

7 Claims, 5 Drawing Sheets

CLEANING DEVICE, IMAGE FORMING APPARATUS, AND TRANSFER UNIT INCLUDING PRESSING UNIT

CROSS-REFERENCE TO RELATED APPLICATIONS

This application is based on and claims priority under 35 USC 119 from Japanese Patent Application No. 2011-259374 filed Nov. 28, 2011.

BACKGROUND

The present invention relates to a cleaning device, an image forming apparatus, and a transfer unit.

SUMMARY

According to an aspect of the present invention, a cleaning device includes a first cleaning member that cleans an outer surface of a belt member by coming into contact with the outer surface, a first opposing member that is in contact with an inner face of the belt member at a position that is opposite the first cleaning member, a second cleaning member that is disposed on a side that is further upstream than the first cleaning member in a travel direction of the belt member, the second cleaning member cleaning the outer surface of the belt member by coming into contact with the outer surface, a second opposing member that is in contact with the inner face of the belt member at a position that is opposite the second cleaning member, and a pressing member that is disposed between the first opposing member and the second opposing member, the pressing member being in contact with the outer surface of the belt member and pressing a portion of the belt member that is located between the first opposing member and the second opposing member from an outer surface side of the belt member toward an inner face side of the belt member.

BRIEF DESCRIPTION OF THE DRAWINGS

An exemplary embodiment of the present invention will be described in detail based on the following figures, wherein.

DETAILED DESCRIPTION

A cleaning device 46 and an image forming apparatus 10 according to an exemplary embodiment of the present invention will be described below with reference to the drawings.

Entire Configuration

Figure 1:
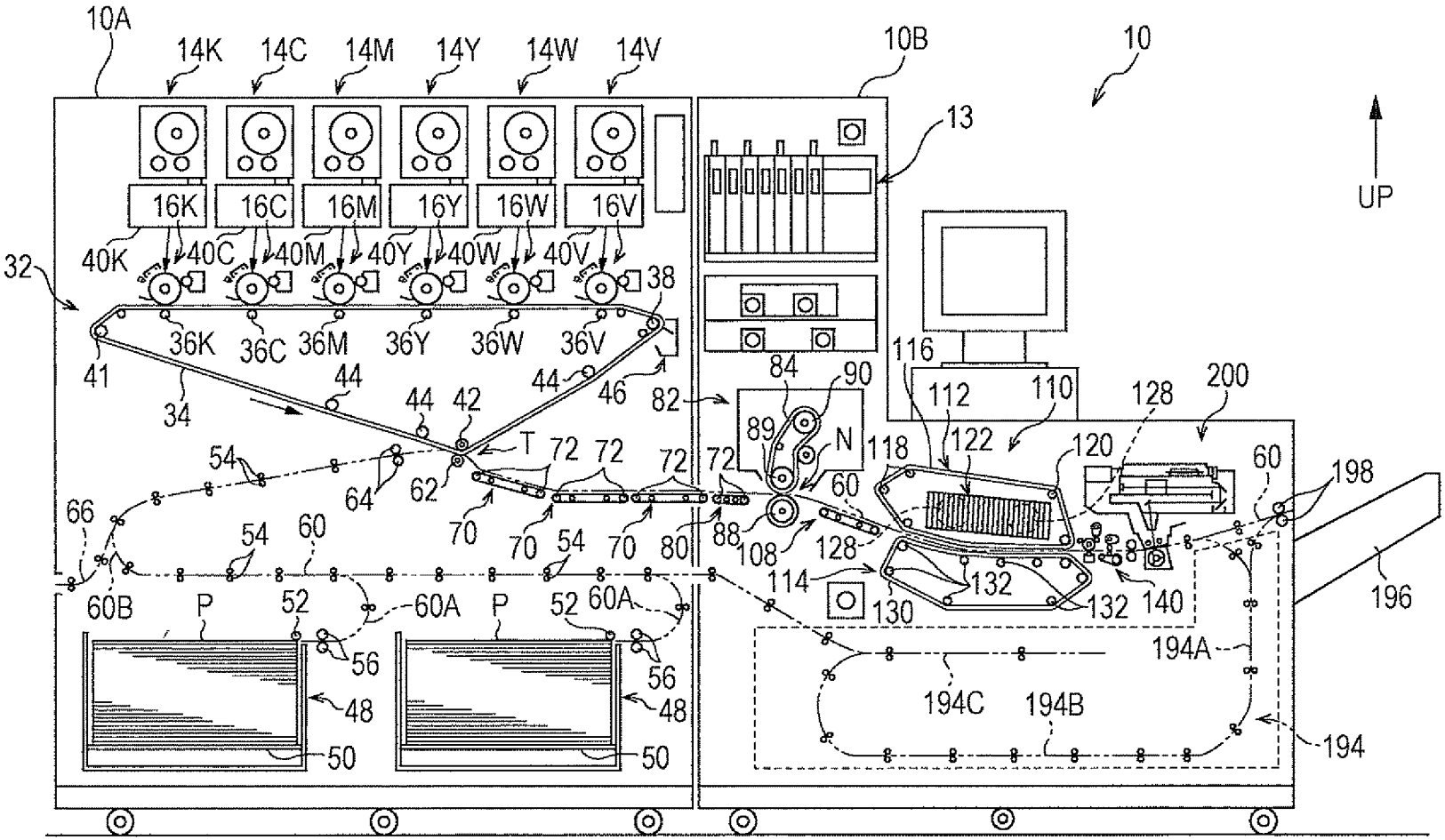
FIG. 1 illustrates a configuration of an image forming apparatus according to an exemplary embodiment of the present invention.

The image forming apparatus 10 according to the exemplary embodiment is an apparatus that forms a full-color image or a monochrome image. As illustrated in FIG. 1, the image forming apparatus 10 includes a first housing 10A and a second housing 10B. The first housing 10A forms a negative side (a left side in FIG. 1) portion of the image forming apparatus 10 in the horizontal direction and contains a first processor. The second housing 10B is detachably joined to the first housing 10A, forms a positive side (a right side in FIG. 1) portion of the image forming apparatus 10 in the horizontal direction, and contains a second processor.

An image signal processor 13, which performs image processing on image data transmitted from an external device, such as a computer, is disposed at an upper portion of the second housing 10B.

Toner cartridges 14V, 14W, 14Y, 14M, 14C, and 14K, which respectively contain toners of a first extra color (V), a second extra color (W), yellow (Y), magenta (M), cyan (C), and black (K), are arranged in the horizontal direction at an upper portion of the first housing 10A so as to be replaceable.

Any color, including transparent, other than yellow, magenta, cyan, and black may be appropriately selected as the first extra color or the second extra color. In the following description, any one of characters V, W, Y, M, C, and K is added to corresponding reference numerals in the case where components corresponding to the first extra color (V), the second extra color (W), yellow (Y), magenta (M), cyan (C), and black (K) need to be distinguished from one another. In the case where components corresponding to the first extra color (V), the second extra color (W), yellow (Y), magenta (M), cyan (C), and black (K) do not need to be distinguished from one another, the characters V, W, Y, M, C, and K are not added to the reference numerals.

Six image forming units 16 corresponding to the toners of different colors are arranged in the horizontal direction below the toner cartridges 14 so as to correspond to the toner cartridges 14.

An exposure unit 40, which is included in each image forming unit 16, receives image data, which has been subjected to image processing by the above-described image signal processor 13, from the image signal processor 13 and radiates an image carrier 18, which will be described below, with a light beam L having been modulated in accordance with the image data (see FIG. 2).

Figure 2:
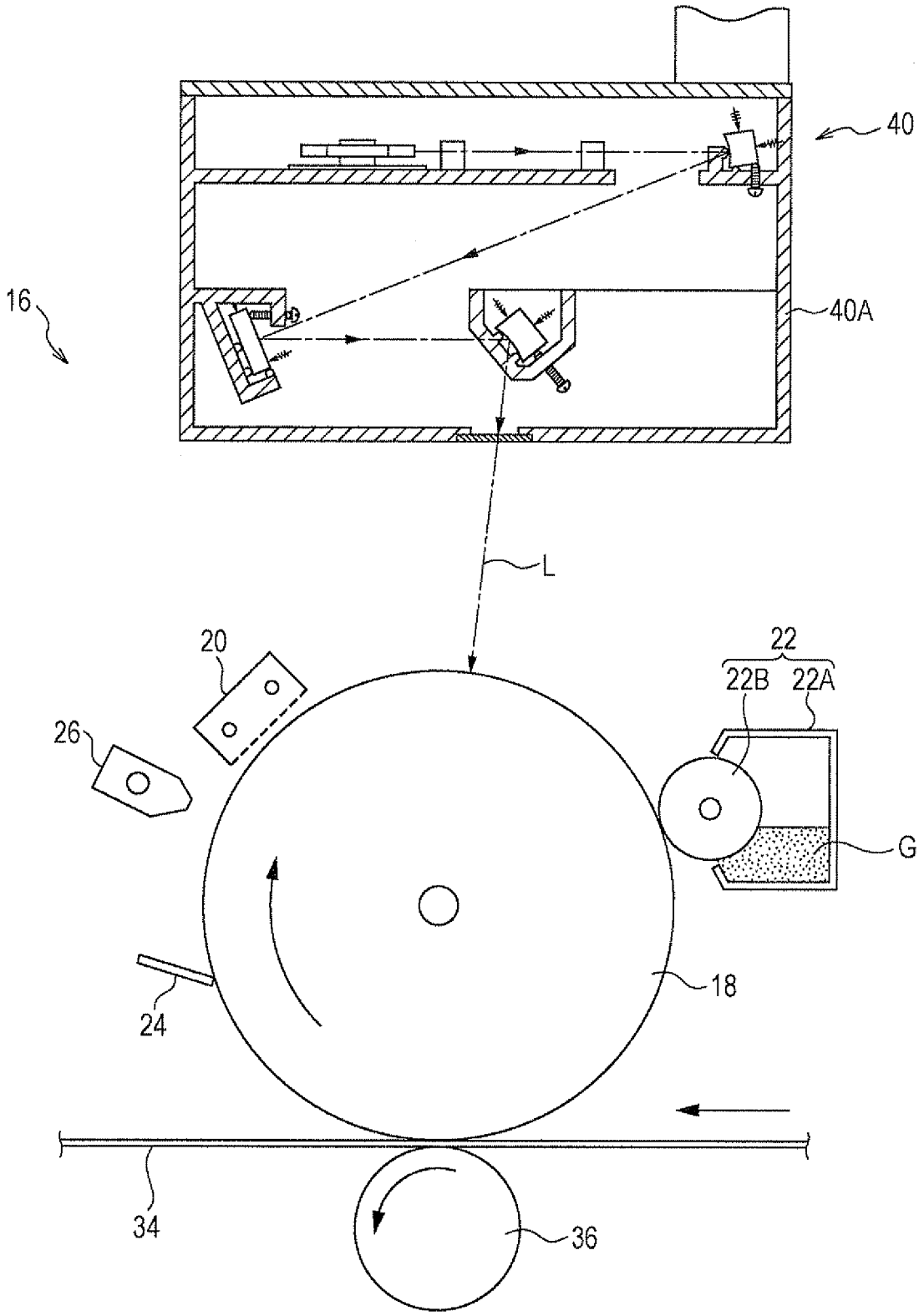
FIG. 2 illustrates a configuration of an image forming unit illustrated in FIG. 1.

As illustrated in FIG. 2, each image forming unit 16 includes an image carrier 18 that is driven so as to rotate in one direction (clockwise direction in FIG. 2). When one exposure device 40 radiates a corresponding image carrier 18 with a light beam L, an electrostatic latent image is formed on the image carrier 18.

A scorotron charger 20, a developing device 22, a blade 24, and a static eliminator 26 are disposed around the image carrier 18. The scorotron charger 20 is a corona discharge type (non-contact type) charger that charges the image carrier 18. The developing device 22 develops an electrostatic latent image, which is formed on the image carrier 18 by the exposure unit 40, with a developer. The blade 24 is an example of a removing member that removes part of the developer remaining on the image carrier 18 after a transfer operation. The static eliminator 26 eliminates the static on the image carrier 18, which is subjected to a transfer operation, by radiating the image carrier 18 with light.

The scorotron charger 20, the developing device 22, the blade 24, and the static eliminator 26 face the surface of the image carrier 18, and are arranged in this order from an upstream side to a downstream side in a direction of rotation of the image carrier 18.

The developing device 22 includes a developer containing member 22A, which contains a developer G containing a toner, and a developing roller 22B that supplies the developer G contained in the developer containing member 22A to the image carrier 18. The developer containing member 22A is connected to a corresponding toner cartridge 14 (see FIG. 1) via a toner supply passage (not illustrated), through which a toner is supplied from the toner cartridge 14 to the developer containing member 22A.

As illustrated in FIG. 1, a transfer unit 32 is disposed below the image forming units 16. The transfer unit 32 includes a circular transfer belt 34 and first transfer rollers 36. The transfer belt 34 comes into contact with the image carriers 18. The first transfer rollers 36 transfer toner images formed on the image carriers 18 to the transfer belt 34 such that the toner images are stacked on top of one another.

The transfer belt 34 is wrapped around a driving roller 38, a tensioning roller 41, an opposing roller 42, and multiple rollers 44. The driving roller 38 is an example of a wrapped roller driven by a motor, which is not illustrated. The tensioning roller 41 places the transfer belt 34 under tension. The opposing roller 42 is disposed so as to oppose a second transfer roller 62, which will be described below. The transfer belt 34 is rotationally moved in one direction (counter-clockwise direction in FIG. 1) by the driving roller 38.

The first transfer rollers 36 are disposed so as to oppose the image carriers 18 of the image forming units 16 with the transfer belt 34 being interposed therebetween. A transfer bias voltage with a polarity that is opposite the polarity of the toner is applied to the first transfer rollers 36 by a power supply unit (not illustrated). With this configuration, the toner images formed on the image carriers 18 are transferred to the transfer belt 34.

The cleaning device 46 is disposed near the driving roller 38. The cleaning device 46 cleans an outer peripheral surface (outer surface) of the transfer belt 34 by bringing a cleaning blade 202, a cleaning brush 204, and a scraper 206, which will be described below, into contact with the transfer belt 34 and thus removing a residue such as toner or paper dust remaining on the transfer belt 34. The cleaning device 46 will be described in detail below.

Two recording-medium containing portions 48 that contain recording media P, such as sheets, are arranged in the horizontal direction below the transfer unit 32.

Each recording-medium containing portion 48 is dismountable from the first housing 10A by being drawn out. Each recording-medium containing portion 48 includes a pick-up roller 52, which feeds a recording medium P from the recording-medium containing portion 48 to a transport path 60, at a position above an end portion (right portion in FIG. 1) of the recording-medium containing portion 48.

A bottom plate 50 on which recording media P are placed is disposed inside each recording-medium containing portion 48. The bottom plate 50 is lowered in accordance with an instruction of a controlling device, which is not illustrated, when the recording-medium containing portion 48 is drawn out from the first housing 10A. After the bottom plate 50 has been lowered, a space, which is to be replenished with recording media P by a user, is generated in the recording-medium containing portion 48.

When the recording-medium containing portion 48 having been drawn out from the first housing 10A is mounted on the first housing 10A, the bottom plate 50 is raised in accordance with an instruction of the controlling device. After the bottom plate 50 has been raised, a topmost one of the recording media P placed on the bottom plate 50 comes into contact with a corresponding pick-up roller 52.

Separation rollers 56, which separate recording media P that are fed in an overlapping manner from each recording-medium containing portion 48 into individual sheets, are disposed on a side that is further downstream than a corresponding pick-up roller 52 in a transportation direction of the recording media (also simply referred to as "the downstream side", below). Multiple transport rollers 54, which transport the recording media P to the downstream side in the transportation direction, are disposed on the downstream side of the separation rollers 56.

The transport path 60, which is formed so as to connect the recording-medium containing portions 48 and the transfer unit 32, extends to a transfer position T that is between the second transfer roller 62 and the opposing roller 42 such that the recording media P fed from the recording-medium containing portions 48 are turned to the left in FIG. 1 at first bending portions 60A and such that the recording media P are turned to the right in FIG. 1 at a second bending portion 60B.

A transfer bias voltage with a polarity that is opposite the polarity of the toner is applied to the second transfer roller 62 by a power supply unit (not illustrated). With this configuration, the toner images of different colors that have been transferred to the transfer belt 34 so as to be stacked on top of one another are second-transferred to a recording medium P, which has been transported along the transport path 60, by the second transfer roller 62.

A preliminary path 66 extends from a side surface of the first housing 10A and merges with the second bending portion 60B of the transport path 60. A recording medium P fed from another recording-medium containing portion (not illustrated) that is disposed so as to be adjacent to the first housing 10A travels along the preliminary path 66 and is fed to the transport path 60.

Multiple transport belts 70, which transport a recording medium P having had toner images transferred thereto toward the second housing 10B, are disposed in the first housing 10A on the downstream side of the transfer position T. A transport belt 80, which transports the recording medium P having been fed from the transport belts 70 to the downstream side, is disposed in the second housing 10B.

Each of the multiple transport belts 70 and 80 is circularly formed, and is wrapped around a pair of rollers 72. One of the paired rollers 72 is disposed on the upstream side in the transportation direction of the recording medium P, and the other, on the downstream side. One of the paired rollers 72 is driven so as to rotate to rotationally move a corresponding transport belt 70 (or 80) in a single direction (clockwise direction in FIG. 1). A suction device (not illustrated) that sucks the recording medium P is disposed on an inner side of each of the transport belts 70 and 80, and the transport belts 70 and 80 transport the recording medium P while causing the recording medium P to be attached to the surfaces thereof.

A fixing unit 82 is disposed on the downstream side of the transport belt 80. The fixing unit 82 fixes the toner images, which have been transferred to the surface of the recording medium P, to the recording medium P with heat and pressure.

The fixing unit 82 includes a fixing belt 84 and a compression roller 88, which is disposed so as to be in contact with the fixing belt 84 from underneath the fixing belt 84. A fixing portion N at which the toner images are fixed to the recording medium P by compressing and heating the recording medium P is disposed between the fixing belt 84 and the compression roller 88.

The fixing belt 84 is formed in a circular shape and is wrapped around a driving roller 89 and a driving roller 90. The driving roller 89 opposes the compressing roller 88 from above the compression roller 88, and the driven roller 90 is disposed on a side that is further upward than the driving roller 89.

The driving roller 89 and the driven roller 90 each have a built-in heating unit, such as a halogen heater. The fixing belt 84 is heated by these heating units.

A transport belt 108, which transports the recording medium P fed from the fixing unit 82 to the downstream side, is disposed on the downstream side of the fixing unit 82. The transport belt 108 has the same configuration as each transport belt 70.

A cooling unit 110, which cools the recording medium P heated by the fixing unit 82, is disposed on the downstream side of the transport belt 108.

The cooling unit 110 includes an absorbing device 112, which absorbs heat of the recording medium P, and a pressing device 114, which presses the recording medium P against the absorbing device 112. The absorbing device 112 is disposed on one side (upper side in FIG. 1) of the transport path 60, and the pressing device 114 is disposed on the other side (lower side in FIG. 1) of the transport path 60.

The absorbing device 112 includes a circular absorbing belt 116, which comes into contact with the recording medium P and absorbs the heat of the recording medium P. The absorbing belt 116 is wrapped around a driving roller 120, which transmits a driving force to the absorbing belt 116, and multiple rollers 118.

A heat sink 122, which is made of aluminum and two-dimensionally comes into contact with the absorbing belt 116 to radiate the heat absorbed by the absorbing belt 116, is disposed on the inner peripheral side of the absorbing belt 116.

Fans 128, which take the heat away from the heat sink 122 and exhaust the heat to the outside, are disposed on the rear side (far side of the plane of FIG. 1) of the second housing 10B.

The pressing device 114 that presses the recording medium P against the absorbing device 112 includes a circular pressing belt 130 that transports the recording medium P while pressing the recording medium P against the absorbing belt 116. The pressing belt 130 is wrapped around multiple rollers 132.

A correcting device 140, which transports the recording medium P while nipping the recording medium P to correct a curve (curling) of the recording medium P, is disposed on the downstream side of the cooling unit 110.

An inline sensor 200 is disposed on the downstream side of the correcting device 140. The inline sensor 200 detects a toner density defect, an image defect, and an image position defect of the toner images that are fixed to the recording medium P, and the position or the shape of the recording medium P.

Output rollers 198 are disposed on the downstream side of the inline sensor 200. The output rollers 198 output the recording medium P, having had an image formed on one surface thereof, to an output unit 196 that is attached to a side surface of the second housing 10B.

In the case of forming images on both surfaces of a recording medium P, the recording medium P fed from the inline sensor 200 is transported to a reversing path 194 that is disposed on the downstream side of the inline sensor 200.

The reversing path 194 includes a branching path 194A that branches from the transport path 60, a transport path 194E along which the recording medium P having been transported from the branching path 194A is transported toward the first housing 10A, and a reversing path 194C along which the recording medium P having been transported from the transport path 194E is transported in the reverse direction in a switchback manner so that the recording medium P is turned upside down.

In this configuration, the recording medium P having been transported in a switchback manner along the reversing path 1940 is transported to the first housing 10A, travels further along the transport path 60 above the recording-medium containing portions 48, and is transported back to the transfer position. T, again.

An image forming process performed by the image forming apparatus 10 will be described now.

Image data having been subjected to image processing by the image signal processor 13 is transmitted to the exposure units 40. Each exposure unit 40 emits a light beam L in accordance with the image data and exposes a corresponding image carrier 18, which has been charged by a corresponding scorotron charger 20, to form an electrostatic latent image.

As illustrated in FIG. 2, the electrostatic latent image formed on the image carrier 18 is developed by a corresponding developing device 22 to form a toner image of either the first extra color (V), the second extra color (W), yellow (Y), magenta (M), cyan (C), or black (K).

As illustrated in FIG. 1, the toner images of different colors formed on the image carriers 18 of the image forming units 16V, 16W, 16Y, 16M, 16C, and 16K are sequentially transferred to the transfer belt 34 by the six first transfer rollers 36V, 36W, 36Y, 36M, 36C, and 36K so as to be stacked on top of one another.

The toner images of different colors having been transferred to the transfer belt 34 so as to be stacked on top of one another are second-transferred by the second transfer roller 62 to a recording medium P having been transported from any of the recording-medium containing portions 48. The recording medium P having had the toner images transferred thereto is transported by the transport belts 70 toward the fixing unit 82 that is disposed in the second housing 10B.

When the toner images of different colors on the recording medium P are heated and compressed by the fixing unit 82, the toner images are fixed to the recording medium P. After the recording medium P having had toner images fixed thereto passes through the cooling unit 110 and is thus cooled down, the recording medium P is fed to the correcting device 140 and a curve occurring in the recording medium P is corrected.

The recording medium P that has had its curve corrected is subjected to detection by the inline sensor 200, which detects whether there is any defect including an image defect on the recording medium P. Then, the recording medium P is output to the output unit 196 by the output rollers 198.

The case is described where another image is formed on a blank surface (back surface) that has no image formed thereon (the case of two-sided printing). After a recording medium P passes through the inline sensor 200, the recording medium P is reversed on the reversing path 194 and then fed to the transport path 60 above the recording-medium containing portions 48. Thereafter, a toner image is formed on the back surface in the same manner as described above.

In the image forming apparatus 10 according to the exemplary embodiment, components for forming images of the first extra color and the second extra color (the image forming units 16V and 16W, the exposure devices 40V and 40W, the toner cartridges 14V and 14W, and the first transfer rollers 36V and 36W) are optionally attachable to the first housing 10A by a user as optional parts. Thus, the image forming apparatus 10 may be configured without including the components for forming images of the first extra color and the second extra color or may be configured by additionally including the components for forming an image of either the first extra color or the second extra color.

Cleaning Device

Now, the cleaning device 46 will be described.

Figure 3:
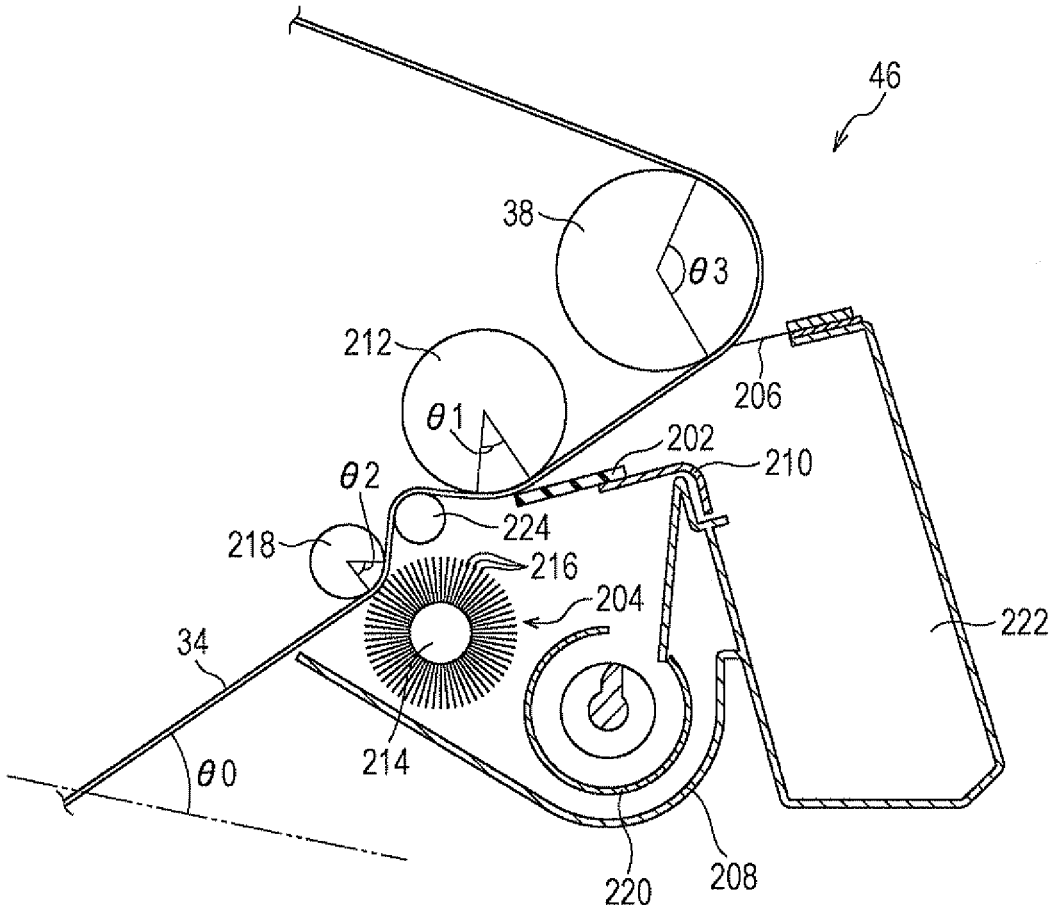
FIG. 3 illustrates a configuration of a cleaning device according to the exemplary embodiment of the present invention.

FIG. 3 illustrates a configuration of the cleaning device 46. The imaginary line illustrated in FIG. 3 indicates a direction that is parallel to the transportation direction of the recording medium P at the transfer position T (see FIG. 1), and part of the transfer belt 34 travels at an angle θ0 with respect to this transportation direction. The cleaning device 46 cleans a region of the transfer belt 34 that travels at the angle θ0 with respect to the transportation direction of the recording medium P.

The cleaning device 46 includes a cleaning blade 202 as an example of a first cleaning member, a cleaning brush 204 as an example of a second cleaning member, and a scraper 206 as an example of a third cleaning member, which come into contact with the outer peripheral surface (outer surface) of the transfer belt 34 in such a manner as to clean the outer peripheral surface.

The cleaning blade 202 is made of a flexible and elastic material such as rubber or resin. One end portion of the cleaning blade 202 is in contact with the outer peripheral surface of the transfer belt 34, and the other end portion of the cleaning blade 202 is supported by a body casing 208 of the cleaning device 46 via a support member 210. An opposing-blade roller 212, which is an example of a first opposing member, is disposed at a position that is opposite the cleaning blade 202 with the transfer belt 34 being interposed therebetween. The opposing-blade roller 212 is in contact with the inner peripheral surface (inner face) of the transfer belt 34 and is driven so as to rotate by movement of the transfer belt 34.

The cleaning brush 204 includes a core member 214 and a large number of fibrous hair members 216 that are implanted in the core member 214. The cleaning brush 204 is rotatably supported by the body casing 208 and is driven so as to rotate by a driving motor (not illustrated). The cleaning brush 204 is disposed such that tips of the hair members 216 come into contact with the outer peripheral surface of the transfer belt 34. An opposing-brush roller 218, which is an example of a second opposing member, is disposed at a position that is opposite the cleaning brush 204 with the transfer belt 34 being interposed therebetween. The opposing-brush roller 218 is in contact with the inner peripheral surface of the transfer belt 34 and is driven so as to rotate by movement of the transfer belt 34.

The scraper 206 is made of a metallic material, such as aluminum or stainless steel. The scraper 206 is in contact with the outer peripheral surface of the transfer belt 34 at a position that is opposite the driving roller 38, which is a wrapped roller around which the transfer belt 34 is wrapped. One end portion of the scraper 206 is supported by the body casing 208 of the cleaning device 46 such that the other end portion is in contact with the outer peripheral surface of the transfer belt 34.

In the cleaning device 46 including the cleaning blade 202, the cleaning brush 204, and the scraper 206, the cleaning brush 204 that is disposed on the most upstream side in the travel direction of the transfer belt 34 firstly brushes off a residue such as remaining toner or paper dust that has adhered to the transfer belt 34 with a relatively low adherence such as an electrostatic force. Secondly, the cleaning blade 202 that is disposed on a side that is further downstream than the cleaning brush 204 in the travel direction of the transfer belt 34 scrapes off a residue such as remaining toner or paper dust that has adhered to the transfer belt 34 with a relatively high adherence due to a transfer pressure of the second transfer roller 62 and the opposing roller 42 at the transfer position T (see FIG. 1). Thirdly, the scraper 206 that is disposed on a side that is further downstream than the cleaning blade 202 in the travel direction of the transfer belt 34 thinly scrapes off a surface layer of the transfer belt 34 to remove a residue such as remaining toner or paper dust that has chemically adhered to the transfer belt 34.

The residues such as remaining toner or paper dust that have been scraped and brushed off by the cleaning blade 202 and the cleaning brush 204 are transported to the outside of the cleaning device 46 by an auger transport device 220 that is disposed below the cleaning blade 202 and the cleaning brush 204. The scrapings of the transfer belt 34 having been scraped off by the scraper 206 are contained in a container 222 below the scraper 206.

The cleaning device 46 includes a pressing roller 224 as an example of a pressing member that helps the cleaning blade 202 and the cleaning brush 204 to stably clean the transfer belt 34. The pressing roller 224 is disposed between the opposing-blade roller 212 and the opposing-brush roller 218. The pressing roller 224 is in contact with the outer peripheral surface of the transfer belt 34 and presses a portion of the transfer belt 34 that is located between the opposing-blade roller 212 and the opposing-brush roller 218 from the outer peripheral surface side toward the inner peripheral surface side of the transfer belt 34. The pressing roller 224 is rotatably supported by the body casing 208 and is driven so as to rotate by movement of the transfer belt 34.

When the pressing roller 224 presses the portion of the transfer belt 34 located between the opposing-blade roller 212 and the opposing-brush roller 218 from the outer peripheral surface side toward the inner peripheral surface side, a wrap angle θ1, which indicates an area over which the opposing-blade roller 212 is in contact with the transfer belt 34, and a wrap angle θ2, which indicates an area over which the opposing-brush roller 218 is in contact with the transfer belt 34, are approximately 40°.

The transfer belt 34 stably moves over a range of the wrap angle θ1 of the opposing-blade roller 212 without oscillating. By bringing the cleaning blade 202 into contact with the transfer belt 34 that is stably moving, the cleaning blade 202 is capable of stably cleaning the transfer belt 34. In other words, if the cleaning blade 202 comes into contact with a portion of the transfer belt 34 that is not in contact with the opposing-blade roller 212, the transfer belt 34 (and the cleaning blade 202) oscillates and thus the cleaning blade 202 is not capable of stably cleaning the transfer belt 34. However, since the wrap angle θ1 is set to approximately 40°, which is a relatively large angle, the cleaning blade 202 is less likely to come into contact with the portion of the transfer belt 34 that is not in contact with the opposing-blade roller 212.

Similarly, the transfer belt 34 stably moves over a range of the wrap angle θ2 of the opposing-brush roller 218 without oscillating. By bringing the cleaning brush 204 into contact with the transfer belt 34 that is stably moving, the cleaning brush 204 is capable of stably cleaning the transfer belt 34. In other words, if the cleaning brush 204 comes into contact with a portion of the transfer belt 34 that is not in contact with the opposing-brush roller 218, the transfer belt 34 (and the cleaning brush 204) oscillates and thus the cleaning brush 204 is not capable of stably cleaning the transfer belt 34. However, since the wrap angle θ2 is set to approximately 40°, which is a relatively large angle, the cleaning brush 204 is less likely to come into contact with the portion of the transfer belt 34 that is not in contact with the opposing-brush roller 218.

The transfer belt 34 is wrapped around the driving roller 38, and thus a wrap angle θ3, which indicates an area over which the driving roller 38 is in contact with the transfer belt 34, is approximately 135°. For this reason, the transfer belt 34 stably moves over a range of the wrap angle θ3 of the driving roller 38 without oscillating. By bringing the scraper 206 into contact with this stable movement range of the transfer belt 34, the scraper 206 is capable of stably cleaning the transfer belt 34.

Figure 4:
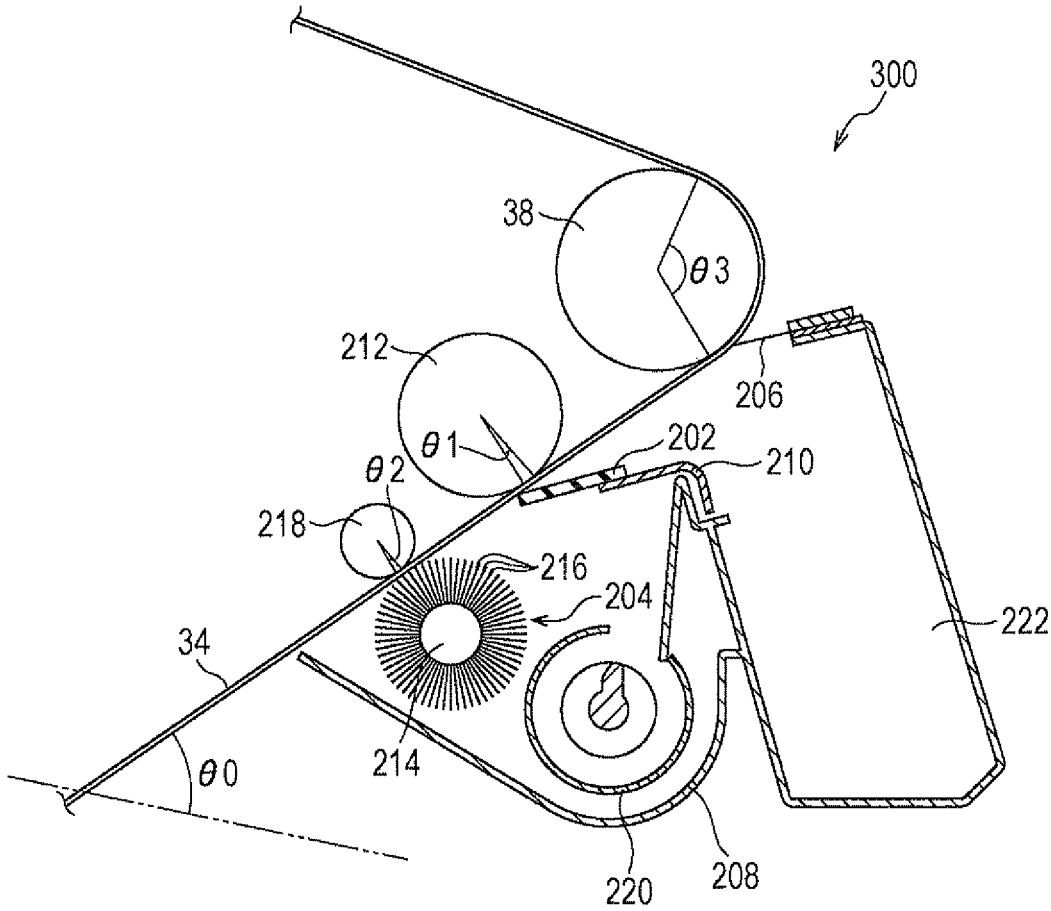
FIG. 4 illustrates a configuration of a cleaning device according to a comparative example for comparison with the cleaning device according to the exemplary embodiment.

FIG. 4 illustrates a cleaning device 300 as a comparative example of the cleaning device 46. The cleaning device 300 is different from the cleaning device 46 in that the cleaning device 300 does not include the pressing roller 224.

Since the cleaning device 300 does not include the pressing roller 224, a wrap angle θ1, which indicates an area over which the opposing-blade roller 212 is in contact with the transfer belt 34, and a wrap angle θ2, which indicates an area over which the opposing-brush roller 218 is in contact with the transfer belt 34, are smaller than the wrap angle θ1 and the wrap angle θ2 in the cleaning device 46. Consequently, the cleaning blade 202 and the cleaning brush 204 of the cleaning device 300 perform cleaning less stably than those of the cleaning device 46.

Figure 5:
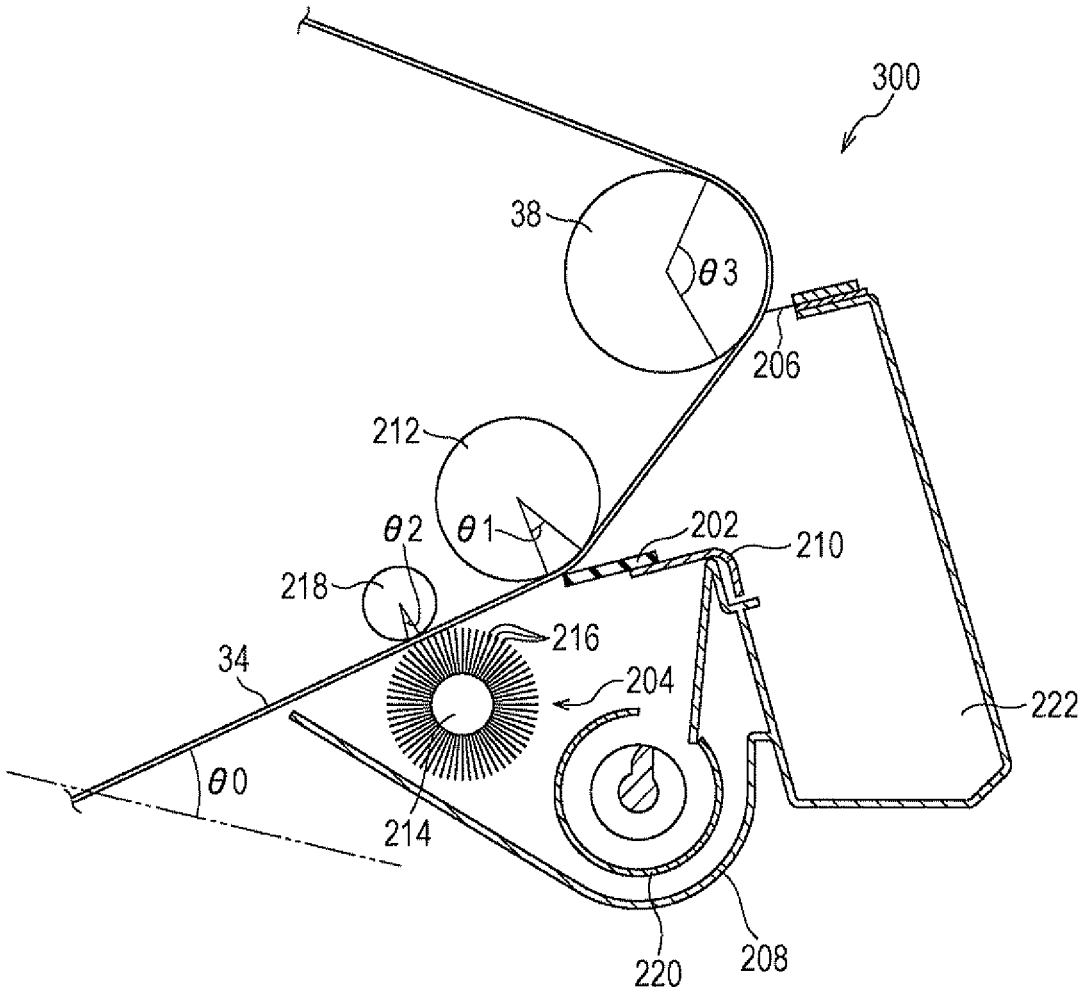
FIG. 5 illustrates a configuration of the cleaning device according to another comparative example for comparison with the cleaning device according to the exemplary embodiment and illustrates the state where an opposing-blade roller is pressed from an inner peripheral surface side of the transfer belt toward an outer peripheral surface side of the transfer belt.

To address this situation, it is conceivable, for example, to increase the wrap angle θ1 at the opposing-blade roller 212 by pressing the opposing-blade roller 212 from the inner peripheral surface side toward the outer peripheral surface side of the transfer belt 34 as illustrated in FIG. 5. In this case, however, an angle θ0 is reduced, the angle θ0 being formed between the transportation direction of the recording medium P and the travel direction of the transfer belt 34. If the angle θ0 is reduced, it becomes harder to release the recording medium P from the transfer belt 34 at the transfer position T (see FIG. 1).

Although not illustrated, if the opposing-brush roller 218 is pressed from the inner peripheral surface side toward the outer peripheral surface side of the transfer belt 34 in order to increase the wrap angle θ2 at the opposing-brush roller 218, the angle θ0 is further reduced. If the angle θ0 is further reduced, it becomes much harder to release the recording medium P from the transfer belt 34 at the transfer position T.

As found from a comparison between FIGS. 3 and 4, the cleaning device 46 has a larger wrap angle θ1, which indicates the area over which the opposing-blade roller 212 is in contact with the transfer belt 34, and a larger wrap angle θ2, which indicates the area over which the opposing-brush roller 218 is in contact with the transfer belt 34, while the angle θ0 remains unchanged, which is an angle between the transportation direction of the recording medium P and the travel direction of the transfer belt 34. The wrap angles θ1 and θ2 are increased by causing the pressing roller 224 to press a portion of the transfer belt 34 located between the opposing-blade roller 212 and the opposing-brush roller 218 from the outer peripheral surface side toward the inner peripheral surface side. Thus, in the cleaning device 46, the cleaning blade 202 and the cleaning brush 204 are capable of stably cleaning the transfer belt 34 while the recording medium P is surely made releasable from the transfer belt 34 at the transfer position T.

The cleaning device 46 also includes the scraper 206 at a position that is located downstream of the cleaning blade 202 and that is opposite the driving roller 38 around which the transfer belt 34 is wrapped. That is, in the configuration in which the scraper 206 is disposed at a position that is opposite the driving roller 38 around which the transfer belt 34 is wrapped, the cleaning blade 202 and the cleaning brush 204 that are disposed on the upstream side of the scraper 206 are subjected to a positional restriction that the cleaning blade 202 and the cleaning brush 204 have to be disposed along the transfer belt 34 that travels at the angle θ0 with respect to the transportation direction. To address this, the pressing roller 224 is added to the cleaning device 46 so that the wrap angle θ1 and the wrap angle θ2 are increased without changing the angle θ0. In other words, even when the cleaning device 46 has a configuration in which the scraper 206 is disposed at a position that is opposite the driving roller 38 around which the transfer belt 34 is wrapped, the cleaning blade 202 and the cleaning brush 204 are capable of stably cleaning the transfer belt 34 while the recording medium P is surely made releasable from the transfer belt 34 at the transfer position T.

In the cleaning device 46, the transfer belt 34 is cleaned in three steps by the cleaning brush 204, the cleaning blade 202, and the scraper 206. Thus, the cleaning device 46 cleans the transfer belt 34 at a high efficiency, and less image defects attributable to residues remaining on the transfer belt 34 occur in subsequent image forming processes. As a result, the cleaning device 46 is capable of forming a high-quality image.

In the cleaning device 46, the cleaning blade 202 is adopted as a first cleaning member, the cleaning brush 204 is adopted as a second cleaning member, and the scraper 206 is adopted as a third cleaning member. However, cleaning members that are in other forms, such as a cleaning web, may be adopted, instead.

The pressing roller 224 is adopted as a pressing member, but the pressing member is not limited to a roller member and may be another member that is capable of pressing the transfer belt 34.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a first cleaning member that cleans an outer surface of a belt member by coming into contact with the outer surface;

a first opposing member that is in contact with an inner surface of the belt member at a position that is opposite the first cleaning member;

a second cleaning member that is disposed further upstream than the first cleaning member in a travel direction of the belt member, the second cleaning member cleaning the outer surface of the belt member by coming into contact with the outer surface;

a second opposing member that is in contact with the inner surface of the belt member at a position that is opposite the second cleaning member; and a pressing member that is disposed between the first opposing member and the second opposing member so as to be intersected by a line that connects the first and second opposing members, the pressing member being in contact with the outer surface of the belt member and being configured to press a portion of the belt member that is located between the first opposing member and the second opposing member from an outer surface side of the belt member toward an inner surface side of the belt member.

2. The cleaning device according to claim 1, further comprising:

a third cleaning member that is disposed further downstream than the first cleaning member in the travel direction of the belt member, the third cleaning member cleaning the outer surface of the belt member by being brought into contact with the outer surface at a position that is opposite a wrapped roller around which the belt member is wrapped.

3. An image forming apparatus comprising:

an image carrier on which an electrostatic latent image is formed;

a developing device that develops the electrostatic latent image formed on the image carrier with a toner;

a transfer device that transfers a toner image developed by the developing device to a recording medium via a transfer belt at a transfer position; and the cleaning device according to claim 1 that cleans the transfer belt.

4. An image forming apparatus comprising:

an image carrier on which an electrostatic latent image is formed;

a developing device that develops the electrostatic latent image formed on the image carrier with a toner;

a transfer device that transfers a toner image developed by the developing device to a recording medium via a transfer belt at a transfer position; and the cleaning device according to claim 2 that cleans the transfer belt.

5. A transfer unit comprising:

a transfer belt that travels at an angle with respect to a transportation direction of a recording medium at a transfer position, at which transfer to the recording medium is performed;

a first cleaning member that cleans an outer surface of the transfer belt by coming into contact with the outer surface;

a first opposing member that is in contact with an inner surface of the transfer belt at a position that is opposite the first cleaning member;

a second cleaning member that is disposed further upstream than the first cleaning member in a travel direction of the transfer belt and in a range in which the transfer belt travels at the angle with respect to the transportation direction, the second cleaning member cleaning the outer surface of the transfer belt by coming into contact with the outer surface;

a second opposing member that is in contact with the inner surface of the transfer belt at a position that is opposite the second cleaning member; and a pressing member that is disposed between the first opposing member and the second opposing member so as to be intersected by a line that connects the first and second opposing members, the pressing member being in contact with the outer surface of the transfer belt and being configured to press a portion of the transfer belt that is located between the first opposing member and the second opposing member from an outer surface side of the transfer belt toward an inner surface side of the transfer belt.

6. The cleaning device according to claim 1, wherein the pressing member is intersected by a line that connects an axis of the first opposing member to an axis of the second opposing member.

7. The transfer unit according to claim 5, wherein the pressing member is intersected by a line that connects an axis of the first opposing member to an axis of the second opposing member.

* * * * *